United States Patent [19]

Mowbray

[11] Patent Number: 4,635,853

[45] Date of Patent: Jan. 13, 1987

[54] FUEL INJECTION NOZZLES

[75] Inventor: Dorian F. Mowbray, Burnham, England

[73] Assignee: Lucas Industries Public Limited Company, Birmingham, England

[21] Appl. No.: 816,963

[22] Filed: Jan. 8, 1986

Related U.S. Application Data

[63] Continuation of Ser. No. 610,030, May 14, 1984, abandoned.

[30] Foreign Application Priority Data

Jul. 9, 1983 [GB] United Kingdom ..... 8318635

[51] Int. Cl.[4] ..... F02M 61/04

[52] U.S. Cl. ..... 239/533.3

[58] Field of Search ..... 239/533.2–533.12, 239/584, 487–489

[56] References Cited

U.S. PATENT DOCUMENTS

| | | | |
|---|---|---|---|
| 1,633,320 | 6/1927 | Franchetti | 239/533.6 X |
| 1,879,985 | 9/1932 | Lümmen | 239/533.3 X |
| 2,068,593 | 1/1937 | Bork | 239/488 X |
| 4,005,826 | 2/1977 | Woodward | 239/533.8 |

FOREIGN PATENT DOCUMENTS

| | | | |
|---|---|---|---|
| 570842 | 2/1933 | Fed. Rep. of Germany | 239/533.11 |
| 2110881 | 5/1972 | Fed. Rep. of Germany | 239/533.11 |

*Primary Examiner*—Andres Kashnikow

[57] ABSTRACT

A fuel injection nozzle includes a valve member axially movable in a bore. The bore is in part defined by a sleeve secured within a drilling. A space is defined between the end of the sleeve and the drilling and fuel under pressure is supplied to the space by means of a groove formed in the external surface of the sleeve. The sleeve serves to support the valve member for axial movement towards and away from a seating defined in the bore and fuel can flow from the space past the valve member and seating through an outlet when the valve member is lifted from the seating.

5 Claims, 3 Drawing Figures

FUEL INJECTION NOZZLES

This application is a continuation, of application Ser. No. 610,030, filed 5/14/84, now abandoned.

This invention relates to a fuel injection nozzle for supplying fuel to an internal combustion engine and of the kind comprising a nozzle body having a bore formed therein, a seating defined at one end of the bore and a resiliently loaded valve member slidable in the bore and shaped for co-operation with the seating, said valve member being urged into contact with the seating by the resilient loading and being lifted from the seating by the action of fuel under pressure to allow fuel flow from an inlet to an outlet.

It is conventional practice to form in the bore an enlargement which is connected to a fuel inlet by way of a drilling formed in the body. The formation of the enlargement in the bore and also the drilling pose manufacturing problems and in addition, the drilling since it runs alongside the bore, requires that the wall thickness between the wall of the bore and the exterior of the body must be sufficient to accommodate the drilling and also to provide adequate wall thickness to withstand the high fuel pressure.

The object of the present invention is to provide a fuel injection nozzle of the kind specified in a simple and convenient form.

According to the invention in a fuel injection nozzle of the kind specified said bore is defined in a sleeve mounted in an elongated recess in the body said sleeve terminating short of the end of the recess to define between the end of the sleeve and the end of the recess, an enlargement, the outer wall of the sleeve and the wall of the recess defining a passage through which fuel can flow to said enlargement from said inlet, the fuel under pressure in the enlargement acting upon said valve member to lift the valve member away from the seating.

An example of a fuel injection nozzle in accordance with the invention will now be described with reference to the accompanying drawings, in which.

Figure 1:
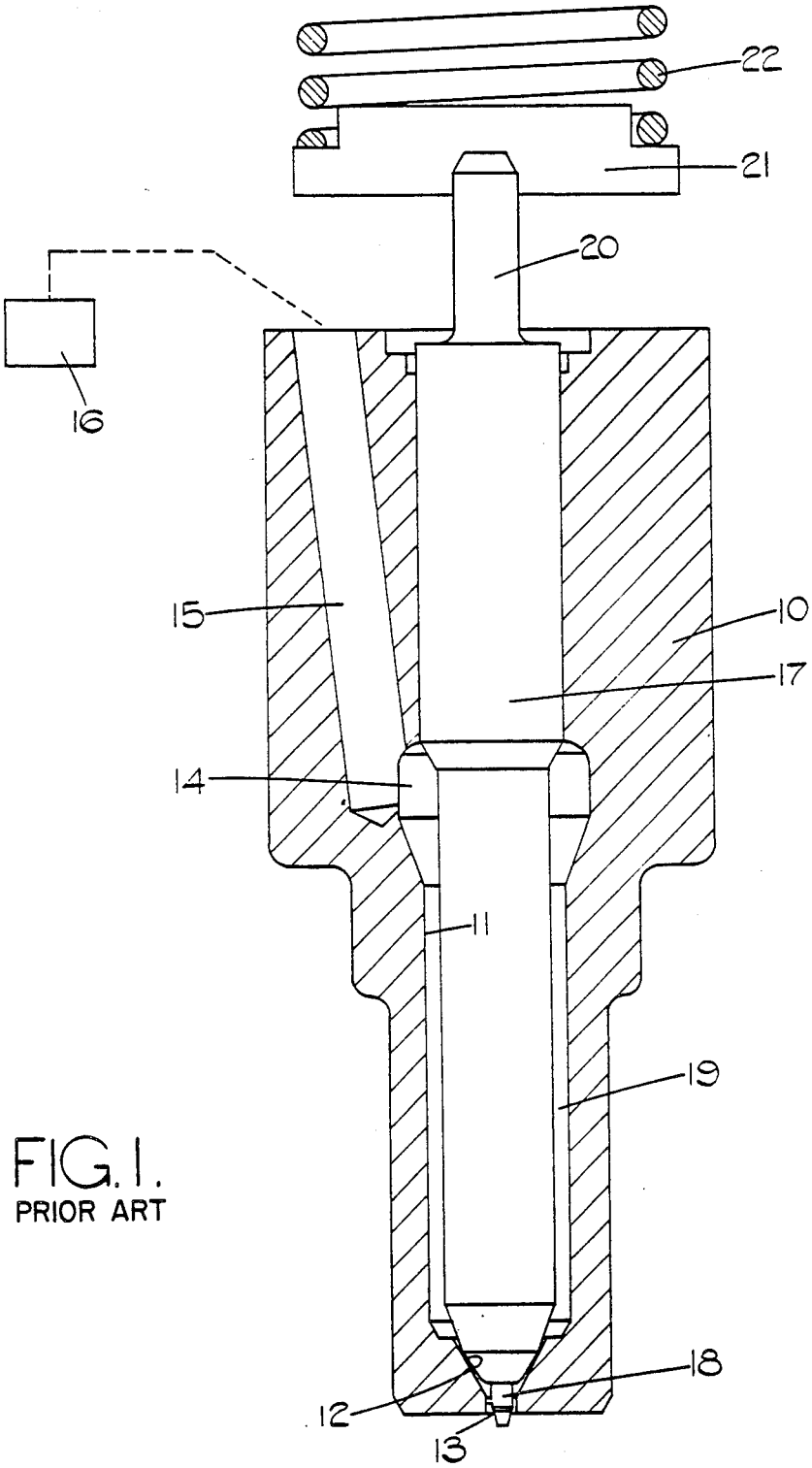
FIG. 1. PRIOR ART
FIG. 1 shows a conventional form of nozzle in sectional side elevation.

Referring to FIG. 1 of the drawings the nozzle comprises a body 10 of stepped form the narrower end of the body in use being exposed within a combustion space of an associated engine. The nozzle body in practice is secured to a support member or holder by means of a cap nut and formed within the body is a blind bore 11 and this extends from the wider end of the body to adjacent the narrower end thereof. At the blind end of the bore there is defined a seating 12 about an outlet opening 13. Intermediate the ends of the bore the latter is provided with an enlargement 14 which communicates with a fuel inlet conveniently formed in the aforesaid holder, by way of an inlet passage 15. The inlet passage 15 runs alongside the bore 11 to the wider end of the body and in use, is connected to the outlet of a fuel injection pump 16.

Located within the bore is a valve member 17 which at its end adjacent the seating is shaped to co-operate with the seating. This end of the valve member also mounts an extension 18 which projects with clearance through the outlet opening 13. The portion of the valve member which is disposed between the enlargement and the blind end of the bore is of reduced diameter to define an annular clearance 19 which communicates with the enlargement 14 to permit passage of fuel from the enlargement through the opening 13 when the valve member is lifted from its seating.

At its end remote from the seating the valve member is provided with a peg 20 which carries a spring abutment 21, the latter being engaged by a coiled compression spring 22. The spring is mounted within a vented chamber defined in the aforesaid holder. In operation, fuel under pressure supplied to the enlargement 14 acts on the differential area of the valve member to create a force which acts to move the valve member against the action of the spring. When the force exerted by the spring is overcome the valve member is lifted from its seating to allow fuel flow through the annular clearance defined between the extension 18 and the wall of the opening 13. The extension is profiled to control the fuel flow through the opening and may also be profiled to alter the shape of the fuel spray and/or the rate at which fuel can flow.

The formation of the enlargement 14 in the bore and also the passage 15 present manufacturing problems. In addition, the fact that the passage 15 extends alongside the bore 17 means that the wall thickness between the wall of the bore and the exterior of the body must be sufficiently large to accommodate the passage.

Figure 2:
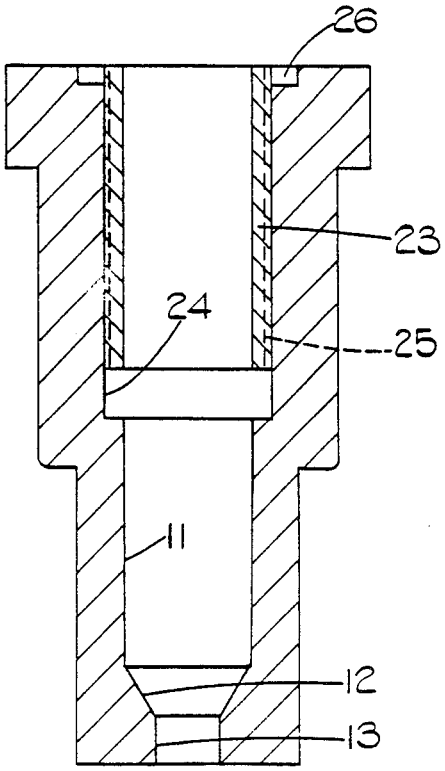
FIG. 2 shows the body of the fuel injection nozzle modified in accordance with the invention.

The manufacturing problems are reduced by, as shown in FIG. 2, supporting the valve member within a bore formed in a sleeve 23 which is supported in a drilling 24 in the body. The bore in the sleeve is conveniently substantially the same diameter as the lower portion of the bore 11 which is formed in the same manner as hithertofore. The sleeve 23 is formed from a hardwearing material and the equivalent of the enlargement 14 is defined between the inner end of the sleeve and the step between the drilling 24 and the bore 11. The sleeve is retained within the drilling in any convenient manner. For example, it may be an interference fit or it may be secured by some form of adhesive for example, an anaerobic adhesive. The sleeve can be formed from a ceramic material for example silicon nitride and the bore in the sleeve is machined after the sleeve has been inserted into the drilling.

Figure 3:
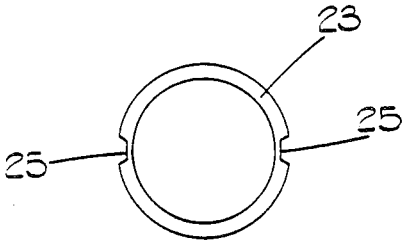
FIG. 3 is a plan view of part of the modified body seen in FIG. 2.

In order to avoid the need for a separate passage 15, the external surface of the sleeve is provided with grooves indicated at 25 in FIG. 3. These grooves communicate with a small recess 26 formed in the wider end of the body, the recess communicating with a passage in the aforesaid holder. The grooves 25 can be of any convenient section. Moreover, since in use, they will contain fuel at high pressure it is convenient in order to equalise the stress in the sleeve, to form the grooves in helical fashion. As a result of providing the grooves, the body can be of reduced diameter since it is no longer necessary to accommodate the passage 15. It also enables the remaining portion of the body to be formed from a material which is better able to withstand impact loads at the seating 12. Moreover, if the material forming the sleeve is formed from an electrically insulating material the valve member in conjunction with the seating, can be used as a switch to provide an indication of when the valve member is lifted from its seating.

As described the nozzle is of the so-called "pintle type". It will be understood that the invention may be applied to a so-called "hole type" nozzle.

I claim:

1. A fuel injection nozzle for supplying fuel to an internal combustion engine comprising a nozzle body having a bore formed therein, an annular fuel receiving chamber on said body adjacent to one end of said bore for receiving fuel, a seating defined at another end of the bore and a resiliently loaded valve member slidable in the bore and shaped for co-operation with the seating, said valve member being urged into contact with the seating by the resilient loading and being lifted from the seating by the action of fuel under pressure to allow fuel flow from an inlet to an outlet, a sleeve mounted in an elongated recess in the body and fixed to the body in the recess, said bore being defined by said sleeve, the sleeve terminating short of the end of the recess to define between the end of the sleeve and the recess an enlargement, the outer wall of the sleeve and the wall of the recess defining only a single passage through which fuel can flow to said enlargement from said inlet and said passage in part being defined by a helical groove formed in the outer wall of the sleeve, said helical groove having an inlet end overlapping said annlular fuel receiving chamber to be directly connected to said fuel receiving chamber and another end directly connected to said enlargement to transfer fuel directly from said fuel receiving chamber to said enlargement and being closed at all other locations for forming the sole fluid connection between said fuel receiving chamber and said enlargement, the fuel under pressure in the enlargement acting upon said valve member to lift the valve member away from the seating.

2. A nozzle according to claim 1 in which said sleeve is formed from a ceramic material.

3. A nozzle according to any one of the preceding claims in which said sleeve is secured by adhesive within the recess.

4. The fuel injection nozzle defined in claim 1 further including an interference fit between the outer surface of said sleeve and the surface of said body defining said recess.

5. The fuel injection nozzle defined in claim 1 further including adhesive means connecting the outer surface of said sleeve and the surface of said body defining said recess.

* * * * *